US008975497B2

(12) United States Patent
Aspri

(10) Patent No.: US 8,975,497 B2
(45) Date of Patent: Mar. 10, 2015

(54) VIBRATION TRANSMISSION ADAPTER FOR A STRING MUSICAL INSTRUMENT

(76) Inventor: Roberto Aspri, Montreal (CA)

( * ) Notice: Subject to any disclaimer, the term of this patent is extended or adjusted under 35 U.S.C. 154(b) by 148 days.

(21) Appl. No.: 13/587,164

(22) Filed: Aug. 16, 2012

(65) Prior Publication Data

US 2013/0042741 A1 Feb. 21, 2013

(30) Foreign Application Priority Data

Aug. 18, 2011 (CA) ..... 2749516

(51) Int. Cl.
*G10D 3/02* (2006.01)
*G10D 1/08* (2006.01)

(52) U.S. Cl.
CPC ... *G10D 3/02* (2013.01); *G10D 1/08* (2013.01)
USPC ..... 84/294

(58) Field of Classification Search
CPC ..... G10D 3/02; G10D 1/08; G10D 3/04; G10D 1/00; G10D 3/12
USPC ..... 84/294
See application file for complete search history.

(56) References Cited

U.S. PATENT DOCUMENTS 3,058,384 A * 10/1962 Musser ..... 84/454
4,762,046 A * 8/1988 Aspri et al. ..... 84/294

* cited by examiner

*Primary Examiner* — Jianchun Qin
(74) *Attorney, Agent, or Firm* — Norton Rose Fulbright Canada LLP

(57) ABSTRACT

A vibration transmission adapter for the transmission of vibrations from strings of a string musical instrument to a sound reverberator device equipped with at least one spring is presented herein to enhance the sound generated by the instrument. The strings are supported in contact with a bridge saddle of the instrument. The vibration transmission adapter includes a rigid metallic member shaped to define a saddle connecting section and an integrally formed spring connecting section. The saddle connecting section is engageable into the bridge saddle and is shaped to extend between and spaced from at least two adjacent strings of a pair of strings. The spring connecting section extends in a rearward direction from a top end of the saddle connecting section and has a spring connecting free end.

8 Claims, 2 Drawing Sheets

VIBRATION TRANSMISSION ADAPTER FOR A STRING MUSICAL INSTRUMENT

TECHNICAL FIELD

The present invention relates to a vibration transmission adapter for the transmission of vibrations from strings of a string musical instrument to a sound reverberator device equipped with at least one spring to enhance the sound generated by the musical instrument and removably secured to the musical instrument.

BACKGROUND ART

In my U.S. Pat. No. 4,762,046, I describe a sound reverberator connectable to a guitar to enhance the tonality of the sound generated by the musical instrument. The reverberator is essentially a sound box having one or more large springs which can respond to the vibrations of the strings of the musical instrument to give maximum resonant effect or change the tonality of the sound generated by the strings and as well as amplify the sound generated by plucking, frictioning, striking or otherwise vibrating the strings of the instrument.

In order to properly transmit the sound and vibrations from the strings there is provided an adapter which is adaptable to the string of the musical instrument and capable of transmitting actual sounds generated by the strings which are placed in vibration. There is a need to provide an adapter which is easy to install and efficient in transmitting sound vibrations of strings.

SUMMARY OF INVENTION

It is a feature of the present invention to provide a vibration transmission adapter which provides the above desired needs.

According to a broad aspect of the present invention there is provided a vibration transmission adapter for the transmission of vibrations from strings of a string musical instrument to a sound reverberator device equipped with at least one spring to enhance the sound generated by the instrument. The strings are supported in contact with a bridge saddle of the instrument. The vibration transmission adapter is comprised by a rigid metallic member shaped to define a saddle contacting section and an integrally formed spring connecting section. The saddle contacting section is shaped to extend between and spaced from at least two adjacent strings of the string musical instrument. The spring connecting section extends in a rearward direction from a top end of the saddle contacting section and has a spring connecting free end.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
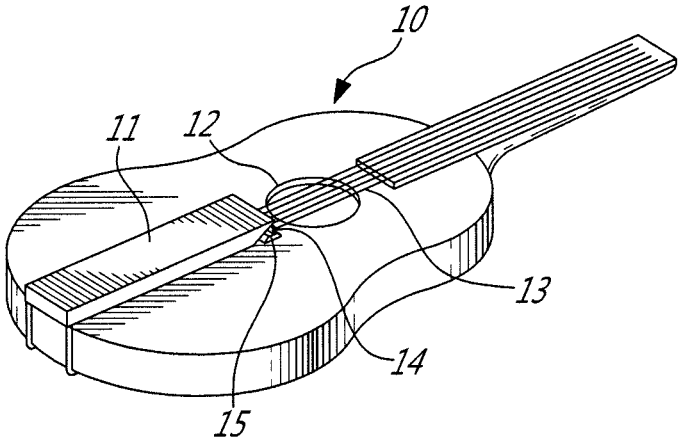
FIG. 1 is a perspective view of a string musical instrument to which is secured a sound reverberator device and equipped with the vibration transmission adapter of the present invention.

Referring to the drawings and more particularly to FIG. 1, there is shown generally at 10 a string musical instrument, herein a guitar. It is hereinshown as equipped with a reverberator device 11 as described in my afore-mentioned U.S. Patent. The instrument 10 is provided with strings 13 which extend over a saddle 14 of a bridge piece 15 to generate sounds in the sound box of the instrument.

Figure 2:
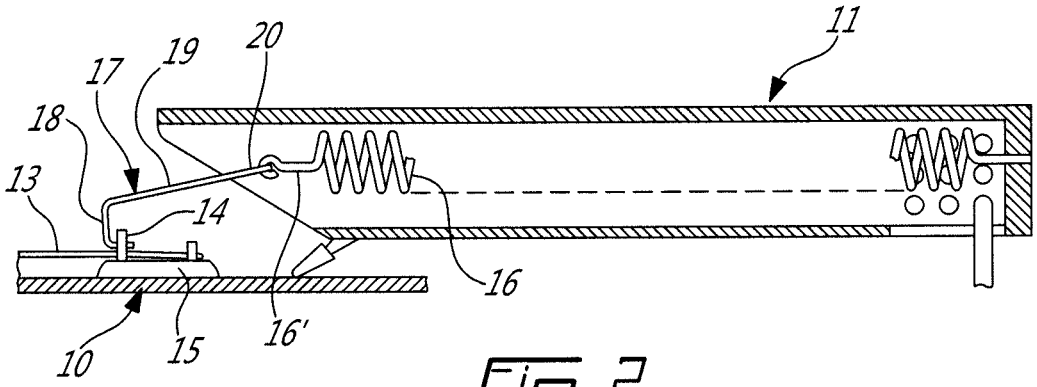
FIG. 2 is a side cross-section view of the sound reverberator device showing the vibration transmission adapter of the present invention connected between the strings and saddle of the string musical instrument and the springs in the reverberator device.
Figure 5:
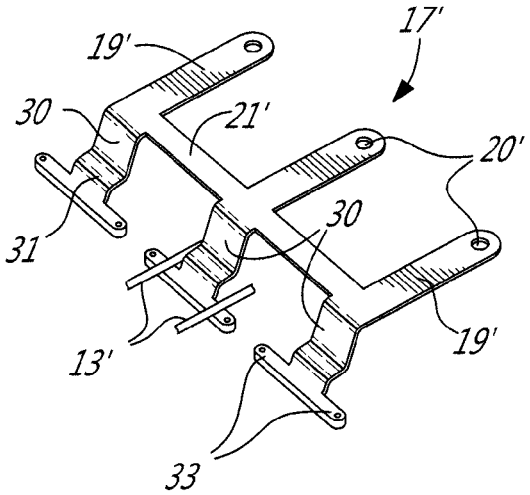
FIG. 5 is a perspective view showing a further example of the vibration transmission adapter of the present invention and wherein it is adapted to engage pairs of strings of a string musical instrument.
Figure 6:
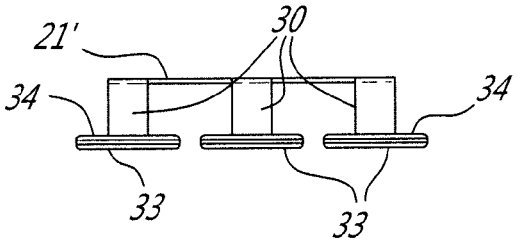
FIG. 6 is a front view of the vibration transmission adapter of FIG. 5.

As shown in FIG. 2, the reverberator device 11 is provided with one or more springs 16 which are supported therein as described in my afore-mentioned U.S. Patent. The front ends 16' of the springs are secured to either one of the vibration adapters 17 and 17' as shown in FIGS. 3 and 5 and as will be described hereinbelow.

Figure 3:
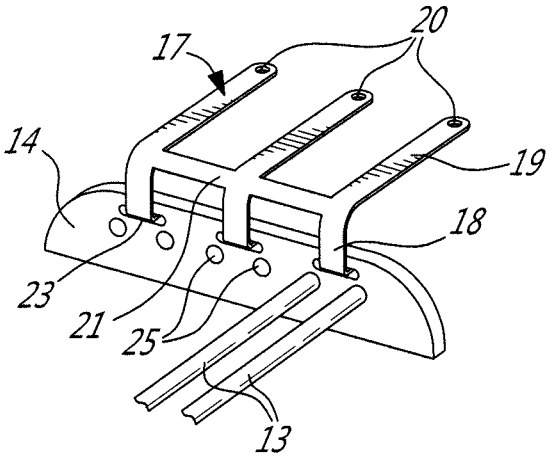
FIG. 3 is a perspective view of a first example of the construction of the vibration transmission adapter of the present invention secured to a modified saddle member of the bridge of the musical instrument.
Figure 4:
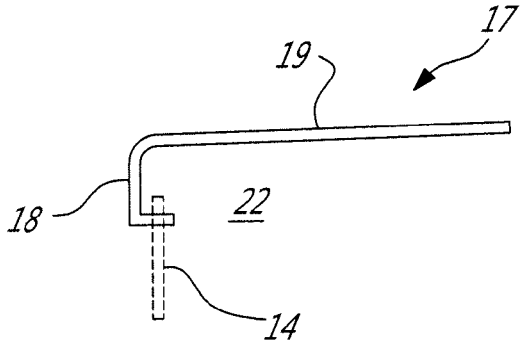
FIG. 4 is a side view of the vibration transmission adapter illustrated in FIG. 3.

With further reference to FIGS. 3 and 4, the vibration transmission adapter 17 is formed as a unitary member die-cut and shaped from a flat metal plate, herein stainless steel, and is shaped to define a saddle contacting section 18 and an integrally formed spring connecting section 19. The saddle contacting section 18 is shaped to extend between and spaced from at least two adjacent strings 13 of the string musical instrument 10. The spring connecting section 19 extends in a rearward direction from a top end of the saddle contacting section, as better shown in FIG. 2 and has a spring connecting free and 20 for connecting to the end 16' of the spring 16. As shown in FIG. 3, there are three saddle connecting sections 18 equidistantly spaced-apart and interconnected together at a top end thereof in a bridge section 21. Accordingly, when the strings 13 are placed into vibration, the vibration is transmitted into the saddle 14 and into the vibration transmission adapter 17 transmitting the vibration into the springs 16 which vibrate and provide a modified tonality to the sound generated by the guitar 10.

The saddle connecting section 18 is better illustrated in FIG. 4 and is comprised of a hook-shaped free end 22 adapted to engage into an associated slot 23 equidistantly spaced in the saddle 14 slightly above an associated pair of strings 13. The strings 13 are guided in holes 25 formed in the saddle and equidistantly spaced. The slots 23 are disposed between associated pairs of holes 25 or strings in contact therein. The saddle is formed for use with a reverberator 11 and the adapter design 17.

Figure 7A:
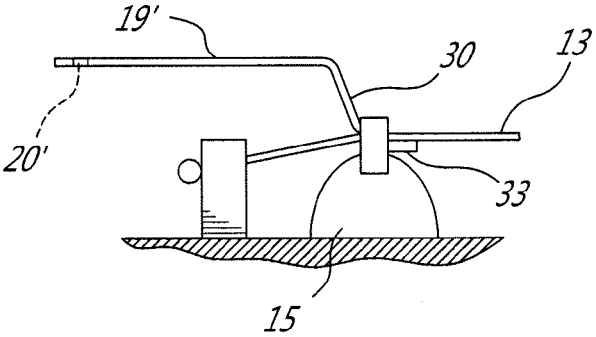
FIG. 7A is a side view showing the vibration transmission adapter of FIG. 5 secured for contact with the strings of a musical instrument.
Figure 7B:
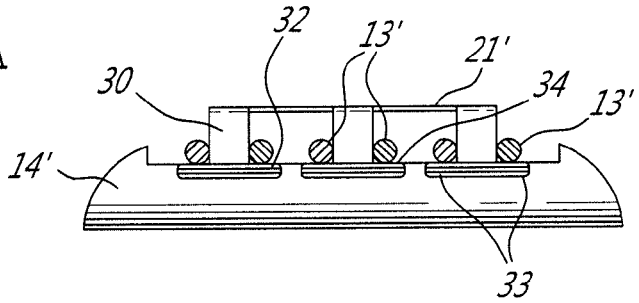
FIG. 7B is a front view of the vibration transmission adapter of FIG. 5 when positioned on a saddle of the bridge of the string musical instrument.

Referring now to FIGS. 5 to 7B, there will be described a further embodiment 17' of the vibration transmission adapter. As hereinshown, the saddle contacting sections are constituted by flat metal arms 30 interconnected together at a top end by a bridge section 21'. Each of the arms 30 have a saddle contacting formation 31 adapted to rest on a top face 32 of a saddle 14' as shown in FIG. 7B. The metal arms are each provided with string contacting fingers 33 projecting in a common horizontal plane in opposite directions at a free end of each flat metal arm. These string contacting fingers 33 are provided with flat inserts 34 formed preferably of the same material as the saddle such as ebony, bone, graphite, ivory or suitable composite materials and secured to the top surface of the fingers 33 by suitable means such as glue or rivets and each of the fingers 33 of each of the arms contact associated ones of a pair of strings, such as the pair shown at 13' in FIG. 5.

When the vibration transmission adapter 17' is positioned onto the saddle 14', the fingers 33 engage a respective pair of strings 13' from underneath the springs in front of the saddle 14' as shown in FIG. 7A. Accordingly, the vibration of the strings and sound emitted thereby is transmitted through the vibration transmission adapter 17' and into three springs 16 secured in the reverberator device 11.

It is within the ambit of the present invention to cover any obvious modifications of the examples of the preferred embodiment described herein, provided such modifications fall within the scope of the appended claims.

I claim:

1. A vibration transmission adapter for the transmission of vibrations from strings of a string musical instrument to a sound reverberator device equipped with at least one spring to enhance the sound generated by said instrument, said strings being supported in contact with a bridge saddle of said instrument, said vibration transmission adapter being comprised by a rigid metallic member shaped to define a saddle connecting section and an integrally formed spring connecting section, said saddle connecting section being removably engageable into said bridge saddle so as to selectively establish a connection therewith, said saddle connecting section being shaped to extend between and spaced from at least two adjacent strings of a pair of strings of said string musical instrument, said spring connecting section extending in a rearward direction from a top end of said saddle connecting section and having a spring connecting free end.

2. A vibration transmission adapter as claimed in claim 1 wherein said string musical instrument is a guitar.

3. A vibration transmission adapter as claimed in claim 1 wherein said rigid metallic member is a flat metal piece, there being a saddle connecting section for each adjacent pair of said strings.

4. A vibration transmission adapter as claimed in claim 3 wherein said saddle connecting section is a saddle connecting hook-shaped free end for attachment in an associated slot formed in said bridge saddle.

5. A vibration transmission adapter as claimed in claim 3 wherein said saddle connecting sections are interconnected together at a top end thereof in a bridge section, there being a string connecting section for each said saddle connecting section for connection to a respective spring of said sound reverberator device.

6. A vibration transmission adapter as claimed in claim 3 wherein said saddle connecting sections are equidistantly spaced flat metal arms interconnected together and each having a saddle connecting formation, and a string connecting finger projecting in opposite directions at a free end of each said flat metal arm in a common horizontal plane for contact with a respective one of said strings of an associated one of said pairs of said strings.

7. A vibration transmission adapter as claimed in claim 6 wherein said string connecting fingers are provided with flat inserts formed of a material which is the same or similar to said saddle.

8. A vibration transmission adapter as claimed in claim 3 wherein said flat metal piece is stainless steel.

* * * * *